US005538299A

United States Patent [19]

Nemeckay

[11] Patent Number: 5,538,299

[45] Date of Patent: Jul. 23, 1996

[54] HOUSING AND SECURING DEVICE

[76] Inventor: Stephen A. Nemeckay, 11060 Peerless, Detroit, Mich. 48224

[21] Appl. No.: 312,816

[22] Filed: Sep. 27, 1994

[51] Int. Cl.[6] ..... E05C 17/02

[52] U.S. Cl. ..... 292/305; 292/256.6

[58] Field of Search ..... 292/305, 306, 292/256.6, 258, 339; 411/432, 519

[56] References Cited

U.S. PATENT DOCUMENTS

| | | | |
|---|---|---|---|
| D. 296,866 | 7/1988 | Behring . | |
| 714,605 | 11/1902 | Potter | 403/344 |
| 727,707 | 5/1903 | Stauffer | 403/344 |
| 772,634 | 10/1904 | Snyder | 403/344 |
| 860,369 | 7/1907 | Grundy | 403/344 |
| 918,078 | 4/1909 | McCaffrey | 403/344 |
| 926,426 | 6/1909 | Koch . | |
| 1,151,131 | 8/1915 | Starliper | 403/344 |
| 1,661,868 | 3/1928 | Armstrong et al. . | |
| 2,191,444 | 5/1938 | Fleming | 403/344 |
| 2,671,355 | 3/1954 | Hawkins . | |
| 2,732,920 | 1/1956 | Newton . | |
| 2,806,722 | 9/1957 | Atkins . | |
| 2,814,067 | 11/1957 | Bowden . | |
| 2,842,387 | 7/1958 | Della-Porta . | |
| 3,023,036 | 2/1962 | Taylor | 403/344 |
| 3,033,599 | 5/1962 | Hudson et al. . | |
| 3,162,084 | 12/1964 | Wurzel | 403/519 |
| 3,324,613 | 6/1967 | Duboff . | |
| 3,566,435 | 3/1971 | Nakamura . | |
| 3,955,828 | 5/1976 | Boudreau . | |
| 4,415,194 | 11/1983 | Bauer . | |
| 4,557,470 | 12/1985 | Link . | |
| 4,709,949 | 12/1987 | Umezawa et al. . | |
| 4,723,765 | 2/1988 | Pearson . | |
| 4,777,698 | 10/1988 | Lord . | |
| 4,815,163 | 3/1989 | Simmons . | |
| 4,824,082 | 4/1989 | Schaupp . | |
| 4,865,169 | 9/1989 | Rachels et al. . | |
| 4,915,538 | 4/1990 | Golden et al. . | |
| 4,925,230 | 5/1990 | Shelton . | |
| 5,000,640 | 3/1991 | Haas | 411/432 |
| 5,024,303 | 6/1991 | Kosloff | 403/344 |
| 5,090,089 | 2/1992 | Schulte et al. . | |
| 5,104,161 | 4/1992 | Kautt . | |
| 5,331,718 | 7/1994 | Gilbert et al. . | |
| 5,335,396 | 8/1994 | Dolan . | |

FOREIGN PATENT DOCUMENTS

| | | |
|---|---|---|
| 1425116 | 9/1988 | U.S.S.R. . |
| 821802 | 10/1959 | United Kingdom . |
| 2139282 | 11/1984 | United Kingdom . |

*Primary Examiner*—Steven N. Meyers
*Assistant Examiner*—Gary Estremsky
*Attorney, Agent, or Firm*—Weintraub DuRoss & Brady

[57] ABSTRACT

A locking device for use with a conventional liftgate support to retain a hatchback-type door of a vehicle in an open position. The locking device of the present invention is for use with a liftgate support to retain a hatchback-type door in an open position even in cold weather or after the liftgate support has worn out. The locking device is defined by a pair of opposed interdigitating body portions which encircle the rod. A threaded member locks the two portions together and secures the device to the rod.

4 Claims, 1 Drawing Sheet

HOUSING AND SECURING DEVICE

BACKGROUND OF THE INVENTION

I. Field of the Invention

The present invention relates generally to securing devices. More particularly, the present invention concerns a securing device for fixing a rod in position. Even more particularly, the present invention provides a securing device for securing an automotive hatchback in an open position.

II. Prior Art

Vehicles having a hatchback-type door have become increasingly popular as the consumer trend towards sportier, more fuel-efficient vehicles continues. Typically, two liftgate supports, one disposed on each side of the hatchback-type door, secure the hatchback in the raised position. After several years of usage or during freezing temperatures, these liftgate supports eventually malfunction, creating a safety hazard to anyone loading or unloading items from the back of the vehicle.

Heretofore, the art has proposed means for preventing the liftgates and other vehicular components from collapsing. For example, U.S. Pat. No. 2,671,355 issued to Hawkins discloses a holding device to retain a vehicle hood or trunk in a raised position. The device includes two members engaged in a telescoping relationship. The holding device includes a first tubular member that slidably receives a rod together with a coiled spring urged locking dog. The locking dog engages the rod with respect to the tubular member, so as to retain the hood or the trunk raised by a pre-determined amount.

In U.S. Pat. No. 4,415,194 there is disclosed a vehicular hatchback-type door closure system which is designed to prevent the downward pivotal rotation of the hatchback-type door. A pair of telescoping struts are positioned such that the studs that secure the strut to the hatchback-type door come into a wedging engagement with the struts to limit the clockwise rotation of the hatchback-type door.

U.S. Pat. No. 5,024,303 issued to Kosloff discloses a hatchback locking device to retain a hatchback-type door of a vehicle in an open position. The locking device comprises a two piece body member where the two pieces are hingedly connected so they may be fit around the liftgate support and then be fastened. The body member is secured to a housing cylinder by two sided tape proximate to where the elongated piston rod is received by the housing cylinder. The two-piece member is expensive to produce and, once attached with tape, is difficult to remove from the housing cylinder.

U.S. Pat. No. Des. 296,866 issued to Behring discloses a lockable sleeve that slips onto the elongated piston rod of the liftgate support to secure the liftgate door in the raised position. The lockable sleeve must then be removed from the liftgate support to lower the hatchback-type door. The sleeve is cumbersome to use and store and can easily damage the liftgate support or the hatchback-type door.

In addition, the Polyon Manufacturing Company has developed a spring-loaded brace for after-market installation that automatically retains a liftgate support of a hatchback-type door in an open position. The brace is expensive and detracts from the appearance of the vehicle when the hatchback-type door is opened.

It is to be appreciated that the prior art devices are cumbersome to install; difficult to manipulate as well as being expensive to manufacture.

What is needed is a securing device that overcomes all of the disadvantages as an after-market lock that is fitted onto one of the liftgate supports, the securing device being universally adapted to virtually any type of cylinder rod.

SUMMARY OF THE INVENTION

The present invention provides a device for housing and securing an elongated rod, the device comprising:

(a) first and second interdigitating opposedly arranged body portions, each of the first and second body portions having an outer surface and an inner surface, each of the first and second body portions having a pedestal and a foot, the foot of the first body portion seating rearwardly of the pedestal of the second body portion and the pedestal of the second body portion seating rearwardly of the foot of the first body portion upon interdigitation, the interdigitated first and second body portions cooperating to define a body member having a central aperture formed therethrough in which the elongated rod is slidably positionable relative to the body member;

(b) at least one locking member for locking the first and second body portions together and securing the body member to the rod thereby precluding the slidable movement of the elongated rod relative to the body member.

Each of the two body portions has a threaded channel formed therein so that when the two body portions are interdigitated, the resulting body member has two channels drawn from its outer surface to its inner surface.

A locking member, such as a screw, fits into either of the two channels and functions to secure the two body portions together, while allowing the elongated rod to slidably move through the central aperture when not engaged therewith.

When fitted further, the threaded screw secures the elongated rod in position by pressing it against the inner surface of the body member. The housing and securing device is now in a fully locked position. In the fully locked position, the body member restricts the movement of the elongated rod into the hydraulic or pneumatic cylinder of a hatchback door mechanism. The elongated rod does not move relative to the body member and the body member cannot fit into the hydraulic or pneumatic cylinder. Therefore, the hatchback-type door is held in an open position until the locking member is withdrawn to the semi-locked position.

The present invention will be more clearly understood with reference to the accompanying drawings. Throughout the various figures, like reference numerals refer to like parts in which:

DETAILED DESCRIPTION OF THE PREFERRED EMBODIMENT

Figure 1:
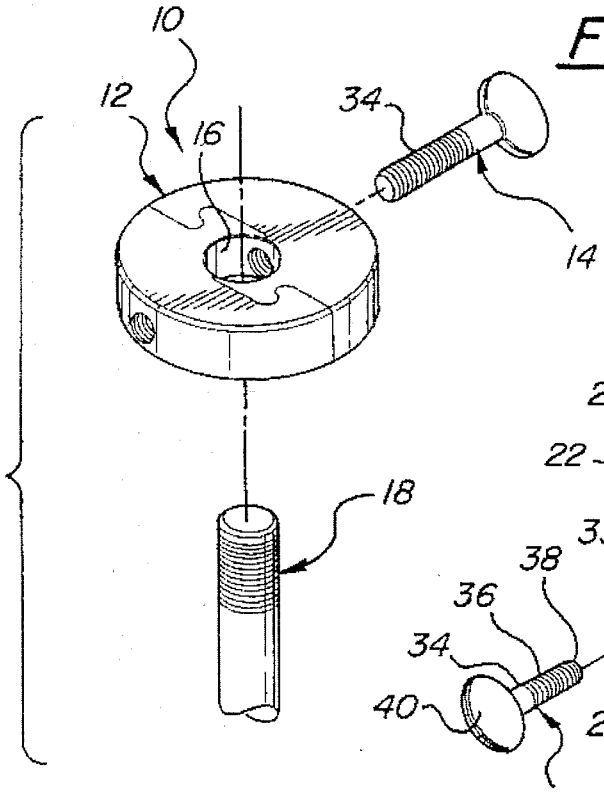
FIG. 1 is a perspective view depicting a preferred embodiment of the housing and securing device.

Referring now to FIG. 1, a preferred embodiment of the housing and securing device of the present invention is depicted, generally, at 10. The housing and securing device 10 includes a body member 12 and a locking member 14. The body member 12 is, generally toroidal in shape and has a first aperture 16 which is designed to slidably encircle an elongated rod 18, such as a piston or rod. The body member may be formed of a variety of materials including various hard plastics or metals.

Figure 2:
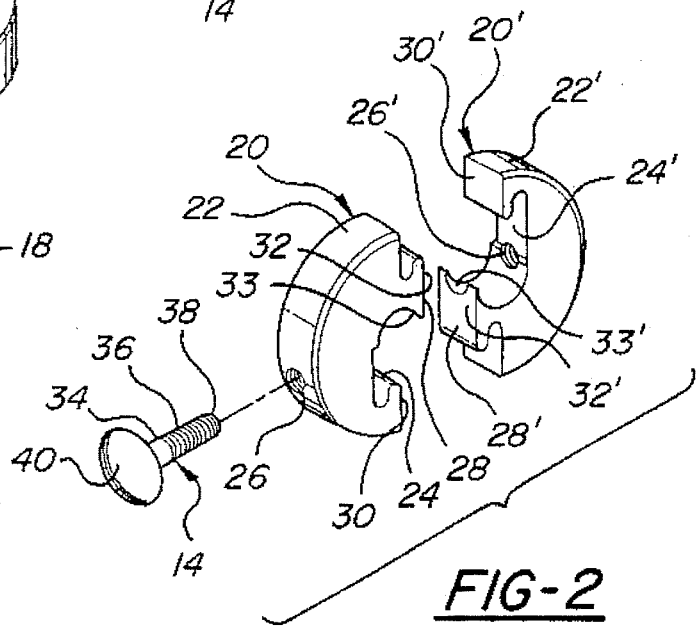
FIG. 2 is a perspective view depicting housing and securing device hereof in an unassembled state.

As shown in FIG. 2, two body portions 20, 20', which are substantially identical and opposedly arrayed, interdigitate to form the body member 12, the two body portions 20, 20' are substantially identical, thus reducing the number of machining steps necessary to produce the locking device 10. For clarity, the description will only reference one of the substantially identical body portions 20, 20'.

The body portion 20, has an outer surface 22, an inner surface 24, and a helically threaded channel 26, drawn between its outer surface 22, and inner surface 24, respectively.

The inner surface 24, of the body portion 20, has a first interdigitating member or foot 28, and a second interdigitating member or pedestal 30.

As shown, the two body portions are opposedly arranged so that the first interdigitating member, or foot 28 of each body portion 20, interdigitates with the second interdigitating member 30, of the other body portion 20, to form the body member 12.

The first intedigitating member 28, of the body portion 20, includes a flange 32.

When the two opposedly arranged body portions 20, 20' are interlocked, the flange 32, defines a portion of the edge of the first aperture 16 formed through the body member 12. The flange 32, has a semi-circular notch 33, cut into it. The semi-circular notch 33, of the flange communicates and is coaxial with the helically threaded channel 26, of the opposedly arranged body portion 20.

More particularly, and as shown in the drawing, the pedestal 30 extends inwardly from the periphery or perimeter of the surface 22. A u-shaped core or recess is provided rearwardly of the pedestal 30, as shown. The recess has a width slightly larger than that of the opposed foot 28' of the other body member so that it nests therein.

Each foot 28 or 28' is disposed or formed interiorly of the respective body portion, as shown.

Each body portion has a shoulder 35,35' formed above the interior opening above the associated channel 26, or 26'. The opposed foot 28 or 28' seats in the opposed shoulder upon interdigitation with its associated notch, cooperating to "round off" the interior opening, as shown. The interior portion of each foot nests in an opposed recess 31 or 31'. Likewise, the interior portion of each pedestal nests in the cut-out provided rearwardly of each foot, as shown.

A locking member 14 such as a helically threaded fastener or screw 34 may be projected or threaded through a channel 26 to lock the two body portions together as well as to secure the device 10 to the rod 18.

The helically threaded fastener has a threaded portion 36, a bearing surface 38 and a finger portion 40. The threaded portion 38 of the locking member 14 is helically threaded so as to be received by either of the helically threaded channels 26 of the two substantially identical body portions 20, 20'. Additionally, the bearing surface 38 of the locking member 14 is preferably made of a soft metal or plastic to prevent damage to the elongated rod 18. The finger portion 40 is designed to allow a person to easily grasp and turn the fastener 34.

Figure 3:
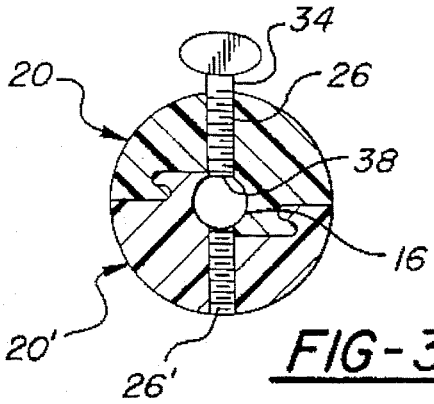
FIG. 3 is a top view of the housing and securing device hereof in a semi-locked configuration.

As shown in FIG. 3, when the body portions 20, 20' are interdigitated and the helically threaded fastener 34 is inserted into one of the helically threaded channels 26, 26' so that the bearing surface 38 of the helically threaded fastener 34 is just short of protruding into the first aperture 16 of the body member 12, the two portions are secured together although the rod is not secured, since the fastener has a length greater than either channel. This is the semi-locked configuration.

In this configuration, a small section 40 of the helically threaded portion 36 of the helically threaded fastener 34 engages the semi-circular notch 33, 33' of the flange 32, 32' on the first interdigitating member 28 or 28' of the opposedly arranged body portion 20, 20'. The elongated rod 18 may still slidably move within the aperture 16 of the body member 12 in this configuration.

Figure 4:
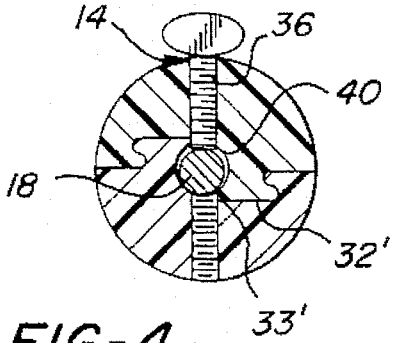
FIG. 4 is a top view of the preferred embodiment of the housing and securing device hereof in a fully locked configuration.

As shown in FIG. 4, when the bearing surface 38 of the helically threaded fastener 34 protrudes into the first aperture 16 of the body member 12 and bears against the elongated rod 18, the two body portions 20, 20' are locked together and the elongated rod 18 is held in place relative to the body member 12.

Figure 5:
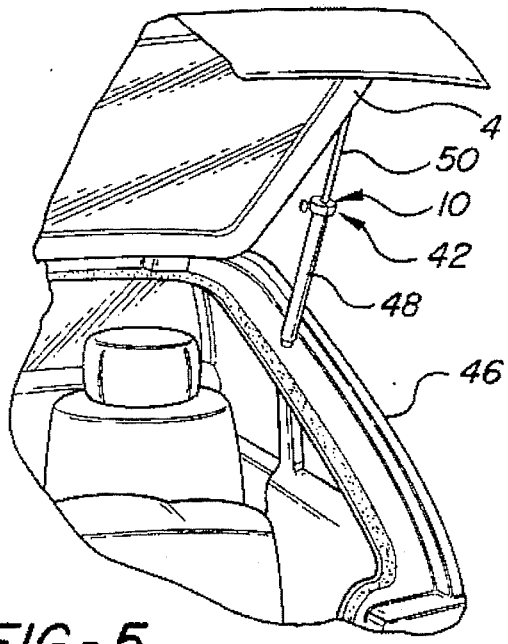
FIG. 5 is an environmental view of the preferred embodiment of the housing and securing device hereof as implemented in a liftgate support system.

Referring now to FIG. 5, the present invention is particularly adapted for use in preventing unwanted slippage of a vehicular hatch-back support such as that depicted at 42. The liftgate support 42 is secured to a hatchback-type door 44 of a passenger vehicle 46 in the well-known manner.

The liftgate support includes a housing cylinder 48 and an elongated piston rod 50. The elongated piston rod 50 is slidably positionable relative to the housing cylinder 48 along the longitudinal axis of the elongated piston rod 50. One end of the housing cylinder 48 is attachable to the vehicle 46 and one end of the elongated piston rod 50 is attachable to the hatchback-type door 44. One end 52 of the elongated piston rod 50 is received within the housing cylinder 48. The locking device 10 rests upon the housing cylinder 48.

The locking device 10 is positioned about the elongated piston rod 50 by placing each of the opposedly arranged body portions 20, 20' about the elongated piston rod. The two body portions are then interdigitated along the longitudinal axis of the elongated piston rod 50 to form the body member 12. The helically threaded fastener 34 is then threaded into either of the helically threaded channels 26, 26' and rotated clockwise until it achieves the configuration of FIG. 4, where the locking device 10 slidably retains the elongated piston rod 50.

To fully lock the piston rod 50 in the open position, the helically threaded fastener 34 is turned clockwise until it reaches the position depicted in FIG. 5.

In this configuration, the elongated piston rod 50 will not slide through the aperture 16 formed in the body member 12. The body member abuts the far end of the housing cylinder 48. Therefore, the elongated piston rod 50 may not slide into the housing cylinder 48. Accordingly, the hatchback-type door 44 is held in an open position.

When the helically threaded fastener 34 is subsequently turned counter-clockwise so that it conforms to the configuration depicted in FIG. 3, the body member 12 remains locked about the elongated piston rod 50 which is once again slidable within the aperture 16 formed through the body member 12. In this way, the hatchback-type door may be closed or opened.

The present invention provides an extremely cost effective way for retaining a hatchback-type door in an open position when the liftgate support has failed to function properly.

Additionally, the present invention may be utilized in a variety of other contexts including as a screen door stopper, a boom extension, and a tip-up for fishing, etc.

As will be realized, the invention is capable of other and different embodiments and its several details are capable of modifications in various obvious respects, all without departing from the invention.

Having, thus, described the present invention, what is claimed is:

1. A locking device comprising:

(a) a body member having two opposite and substantially flat sides, an outer periphery defining the thickness of the locking member, and an aperture substantially centered with respect to the sides and extending through the thickness of the body member defining a longitudinal axis, the aperture adapted for housing and securing an elongated rod, the body member further comprising:

(i) first and second opposedly-arranged, substantially identical body portions, adapted to be freely slidable in a direction parallel to the longitudinal axis of the aperture, each of the first and second body portions having a male pedestal portion, a male foot portion, a U-shaped recess, and an inner surface, wherein each inner surface defines a first female portion for axially slidably receiving the male foot portion of each opposite body portion in an interdigitating relationship and each U-shaped recess of each body portion defines a second female portion for axially slidably receiving the male pedestal portion of each opposite body portion in an interdigitating relationship, the body portions being prevented from radial disengagment by said interdigitation of the two body portions;

(ii) a threaded channel extending radially through the body member's outer periphery and into the aperture, the channel extending through each body portion's inner surface and through the interdigitated foot portion of the other body portion thereby defining a notch in the foot portion of the other body member;

(b) a threaded locking member for engaging in said channel when the body portions are assembled onto an elongated shaft, the locking member having two positions:

(i) a first position in which the locking member extends through the inner portion of a first body portion and through the notch of the foot of a second body portion thereby preventing relative axial movement of the body portions but allowing axial sliding movement of the locking device relative to an elongated rod extending through the aperture; and (ii) a second position in which the locking member is adapted to be further inserted so as to radially enter the aperture and lockingly engage with the elongated rod, thereby preventing axial sliding movement of the locking device relative to the elongated rod.

2. The device of claim 1 wherein the body member is substantially disc shaped.

3. The device of claim 1, wherein the threaded fastener has a head adapted for turning by hand.

4. The device of claim 1, wherein the locking device is adapted to be assembled to the lift-gate support of a hatch-back-type door of a vehicle to prevent unwanted closing of the door.

* * * * *